US008246275B2

(12) United States Patent
Rainey

(10) Patent No.: US 8,246,275 B2
(45) Date of Patent: Aug. 21, 2012

(54) ANCHORED CANTILEVER USING MODULAR BLOCK

(75) Inventor: Thomas L. Rainey, Marietta, GA (US)

(73) Assignee: Earth Reinforcement Technologies, LLC, Woodstock, GA (US)

( * ) Notice: Subject to any disclaimer, the term of this patent is extended or adjusted under 35 U.S.C. 154(b) by 134 days.

(21) Appl. No.: 12/834,264

(22) Filed: Jul. 12, 2010

(65) Prior Publication Data

US 2011/0020070 A1 Jan. 27, 2011

Related U.S. Application Data

(60) Provisional application No. 61/227,966, filed on Jul. 23, 2009.

(51) Int. Cl.
*E02D 29/02* (2006.01)

(52) U.S. Cl. ..... 405/262; 405/284; 405/286

(58) Field of Classification Search ..... 405/262, 405/284, 285, 286, 287
See application file for complete search history.

(56) References Cited

U.S. PATENT DOCUMENTS

| | | | | |
|---|---|---|---|---|
| 5,564,865 | A * | 10/1996 | Jansson | 405/286 |
| 6,299,386 | B1 * | 10/2001 | Byrne et al. | 405/262 |
| 6,336,773 | B1 * | 1/2002 | Anderson et al. | 405/262 |
| 6,402,435 | B1 * | 6/2002 | Lewis | 405/262 |
| 6,431,797 | B2 * | 8/2002 | Greenberg | 405/262 |
| 6,632,048 | B2 * | 10/2003 | Greenberg | 405/262 |
| 6,908,263 | B1 * | 6/2005 | Ruel et al. | 405/262 |
| 6,912,823 | B2 * | 7/2005 | MacDonald et al. | 405/262 |
| 7,114,887 | B1 * | 10/2006 | Rainey | 405/262 |
| 7,387,472 | B2 * | 6/2008 | Abella | 405/284 |
| 2005/0265792 | A1 * | 12/2005 | Lee | 405/262 |

* cited by examiner

*Primary Examiner* — Frederick L Lagman
(74) *Attorney, Agent, or Firm* — Thomas, Kayden, Horstemeyer & Risley, LLP

(57) ABSTRACT

A modular block wall system is provided. In one embodiment, among others, the system comprises a modular block wall adjacent to earth material, the wall exhibiting an elevational angle; a first elongated member passing through the wall along the angle, the first elongated member secured at a bottom end and secured at a top end to the wall; and a second elongated member coupled, directly or indirectly, to the top end of the first elongated member and passing generally vertically downwardly into and secured in the earth material.

4 Claims, 1 Drawing Sheet

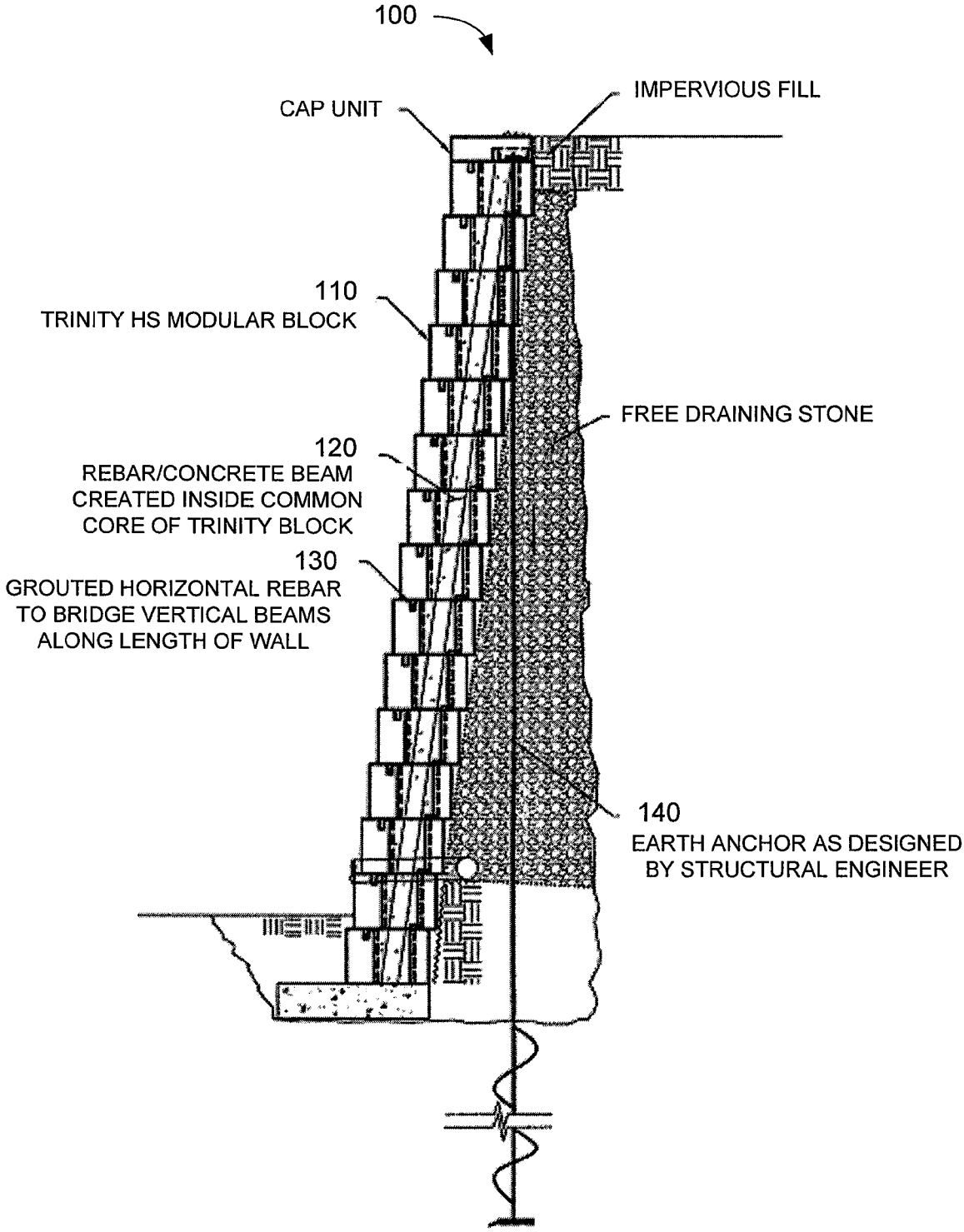
100
CAP UNIT
IMPERVIOUS FILL
110
TRINITY HS MODULAR BLOCK
FREE DRAINING STONE
120
REBAR/CONCRETE BEAM
CREATED INSIDE COMMON
CORE OF TRINITY BLOCK
130
GROUTED HORIZONTAL REBAR
TO BRIDGE VERTICAL BEAMS
ALONG LENGTH OF WALL
140
EARTH ANCHOR AS DESIGNED
BY STRUCTURAL ENGINEER

ANCHORED CANTILEVER USING MODULAR BLOCK

CROSS-REFERENCE TO RELATED APPLICATION

This application claims priority to U.S. provisional application entitled, "Modular Block Structures," having Ser. No. 61/227,966, filed Jul. 23, 2009, which is entirely incorporated herein by reference.

BACKGROUND

Modular earth retaining walls are commonly used for architectural and site development applications. Such walls are subjected to very high pressures exerted by lateral movements of the soil, temperature, and shrinkage effects, and seismic loads. Therefore, backfill soil typically must be braced with tensile reinforcement members. These reinforcement members typically extend rearwardly from the wall and into the soil. The weight of the soil constrains the reinforcement members from lateral movement to thereby stabilize the retaining wall. A variety of retaining wall structures and reinforcement systems exist, such as those disclosed in U.S. Pat. No. 5,921,715, which is entirely incorporated herein by reference; U.S. Pat. No. 6,322,291, which is entirely incorporated herein by reference; U.S. Pat. No. 6,338,597, which is entirely incorporated herein by reference; U.S. Pat. No. 6,416,257, which is entirely incorporated herein by reference; U.S. Pat. No. 6,652,196, which is entirely incorporated herein by reference; U.S. Pat. No. 6,612,784, which is entirely incorporated herein by reference; and U.S. Pat. No. 6,758,636, which is entirely incorporated herein by reference. Although several different forms of reinforcement members have been developed, opportunities for improvement remain with respect to attachment of the reinforcement members to blocks in the retaining wall systems.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 1 is a diagram of a side view of one embodiment of a modular retaining wall utilizing a cantilever anchoring system.

DETAILED DESCRIPTION

Disclosed herein are various embodiments of methods related to modular retaining wall structures. Reference will now be made in detail to the description of the embodiments as illustrated in the drawings, wherein like reference numbers indicate like parts throughout the several views.

Site conditions during development of real estate improvements may sometimes require a near vertical site earth retaining wall to restrain soil at a grade change. To reduce a retaining wall's footing width or anchor/geogrid encroachment behind the retaining wall which may impact adjacent property, an anchored cantilever wall solution is possible with a modular block system.

Modular or segmental retaining walls commonly comprise courses or tiers of modular units or blocks. The blocks are typically made of concrete. The blocks are typically dry-stacked (no mortar or grout is used), and often include one or more features adapted to properly locate adjacent blocks and/or courses with respect to one another, and to provide resistance to shear forces from course to course. The weight of the blocks is typically in the range of ten to one hundred fifty pounds per unit. Modular retaining walls commonly are used for architectural and site development applications. Such walls are subjected to high loads exerted by the soil behind the walls. These loads are affected by, among other things, the character of the soil, the presence of water, temperature and shrinkage effects, and seismic loads. To handle the loads, modular retaining wall systems often comprise one or more layers of soil reinforcement material extending from between the tiers of blocks back into the soil behind the blocks.

FIG. 1 illustrates an embodiment of an anchoring system constructed in accordance with the present disclosure. In this particular example, a retaining wall 100 is constructed with, but not limited to, modular blocks 110. In one embodiment, the modular block 110 can create a reinforced concrete beam 120 by use of common cores within the blocks 110 filled with rebar and/or grout in fill. Modular block systems, such as, but are not limited to, those disclosed in U.S. Pat. No. 7,114,887 entitled "Modular Block Anchoring Techniques", which is entirely incorporated herein by reference, and U.S. Pat. Nos. D530,832 entitled "Block Design for Retaining Wall", D527,113 entitled "Block Design for Retaining Wall", and D526,067 entitled "Block Design for Retaining Wall", which are all entirely incorporated herein by reference, contain a horizontal core 130 that allows the installation of rebar and concrete to bridge vertical beams and aid in forming a rigid face. The rigid face can then be used in conjunction with one or more earth anchors 140 to produce a cantilever resistance for the retaining wall to be restrained and provide containment for the earth behind the wall 100. As shown in FIG. 1, the earth anchor 140 extends vertically from near the top of the wall 100 to an anchor point below the wall footing. In the embodiment of FIG. 1, a cap unit 150 covers the top of the wall 100 and the top of the earth anchor 140. An advantage of the anchored cantilever wall is to allow maximum use of real estate where grade changes require an earth retaining wall.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A modular block wall system, comprising:

a generally vertical passageway formed within a wall, the passageway extending from a top of the wall to a bottom of the wall;

a generally vertical earth anchor adapted to be embedded into soil and/or rock, the earth anchor having a proximal portion extending into the top of the passageway;

at least one elongated member positioned within the vertical passageway directly adjacent the proximal portion of the earth anchor, wherein tensile forces imposed upon the earth anchor are transmitted to the at least one elongate member so as to distribute the tensile forces throughout a portion of the retaining wall; and an opening formed in a rear surface of a wall block such that a proximal portion of a earth anchor extends into the vertical passageway through the opening.

2. The system of claim 1, wherein the wall comprises a plurality of dry-stacked modular blocks.

3. A system, comprising:

a modular block wall assembly including a passageway extending from a top of the wall assembly to a bottom of the wall assembly;

a vertical earth anchor including a first end configured to extend from the top of the wall assembly and a second end configured to embed into soil and/or rock; and an elongated member positioned within the passageway to distribute tensile forces imposed upon the earth anchor throughout a portion of the wall assembly.

4. A system, comprising:

a modular block wall adjacent to earth material, the wall exhibiting an elevational angle;

a first elongated member passing through the wall along the angle, the first elongated member secured at a bottom end and secured at a top end to the wall; and a second elongated member coupled, directly or indirectly, to the top end of the first elongated member and passing generally vertically downwardly into and secured in the earth material.

* * * * *